US009926792B2

(12) United States Patent
Tsutsui

(10) Patent No.: US 9,926,792 B2
(45) Date of Patent: Mar. 27, 2018

(54) TURBO-MOLECULAR PUMP

(71) Applicant: SHIMADZU CORPORATION, Kyoto (JP)

(72) Inventor: Shingo Tsutsui, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 669 days.

(21) Appl. No.: 14/457,233

(22) Filed: Aug. 12, 2014

(65) Prior Publication Data

US 2015/0063993 A1 Mar. 5, 2015

(30) Foreign Application Priority Data

Aug. 30, 2013 (JP) ..... 2013-179614

(51) Int. Cl.

| | |
|---|---|
| ***F01D 5/28*** | (2006.01) |
| ***F04D 19/04*** | (2006.01) |
| ***F04D 29/54*** | (2006.01) |
| ***F04D 29/02*** | (2006.01) |
| ***F04D 29/64*** | (2006.01) |

(52) U.S. Cl.

CPC ..... *F01D 5/288* (2013.01); *F04D 19/042* (2013.01); *F04D 29/023* (2013.01); (Continued)

(58) Field of Classification Search

CPC ..... F04D 19/042

See application file for complete search history.

(56) References Cited

U.S. PATENT DOCUMENTS 8,308,427 B2 * 11/2012 Tsutsui ..... F04D 17/168 415/121.2

2002/0108569 A1 8/2002 Yamauchi (Continued)

FOREIGN PATENT DOCUMENTS

JP 1-95595 6/1989

JP 05-321879 A 12/1993

(Continued)

OTHER PUBLICATIONS

English translation of Chinese Office Action and Search Report dated Jul. 1, 2016 for corresponding Chinese Application No. 201410334765.9.

(Continued)

*Primary Examiner* — Logan Kraft

*Assistant Examiner* — Jason Fountain

(74) *Attorney, Agent, or Firm* — Renner Otto Boisselle & Sklar, LLP

(57) ABSTRACT

A turbo-molecular pump comprises: a case having a suction port and a flange; a rotor assembly housed inside the case, the rotor assembly having a shaft and a rotor integrated with the shaft with a fastening bolt, the rotor having a plurality of rotor blades formed thereon; a plurality of stator blades housed inside the case and arranged to face the rotor blades; and a plurality of spacers stacked along a peripheral surface of the case, the spacer fixing the stator blades. An anti-corrosion treatment is applied to a gas contacting section in a component that is provided on an evacuation upstream side with respect to an evacuation downstream side end of the first rotor blade from the evacuation upstream side and made of an alloy containing Fe or Cr.

15 Claims, 12 Drawing Sheets

(52) U.S. Cl.
CPC ..... *F04D 29/541* (2013.01); *F04D 29/644* (2013.01); *F05D 2230/64* (2013.01); *F05D 2260/95* (2013.01); *F05D 2300/11* (2013.01); *F05D 2300/132* (2013.01); *F05D 2300/17* (2013.01)

(56) References Cited

U.S. PATENT DOCUMENTS

| | | | | |
|---|---|---|---|---|
| 2010/0215532 | A1 | 8/2010 | Tsutsui | |
| 2013/0129482 | A1 * | 5/2013 | Tsutsui ..... | F04D 19/042 415/118 |

FOREIGN PATENT DOCUMENTS

| | | | |
|---|---|---|---|
| JP | H074383 (A) | * | 1/1995 |
| JP | 09-303289 | A | 11/1997 |
| JP | 11-247790 | A | 9/1999 |
| JP | 2001-193686 | | 7/2001 |
| JP | 2002-070788 | A | 3/2002 |
| JP | 2002-227765 | A | 8/2002 |
| JP | 3144272 | U | 7/2008 |
| JP | 2012-237285 | A | 12/2012 |
| WO | WO 2008/139614 | A1 | 11/2008 |
| WO | WO 2012/18111 | A1 | 2/2012 |

OTHER PUBLICATIONS

English translation of Submission of Information dated Dec. 2, 2016 for corresponding Japanese Application No. 2013-179614.
English translation of Chinese Office Action dated Mar. 27, 2017 for corresponding Chinese Application No. 201410334765.9.
English translation of Notice of Reasons for Rejection dated Apr. 25, 2017 for corresponding Japanese Application No. 2013-179614.

* cited by examiner

TURBO-MOLECULAR PUMP

TECHNICAL FIELD

The present invention relates to a turbo-molecular pump.

BACKGROUND ART

In the process of dry etching, CVD, or the like in semiconductor manufacturing processes, processing is performed inside a high vacuum process chamber (hereinbelow, also referred to as a vacuum chamber). In the processing, in order to discharge gas existing inside the vacuum chamber to form a constant high vacuum degree, for example, a vacuum pump such as a turbo-molecular pump is used.

In the vacuum chamber, chlorine-based or fluorine-based process gas is used. The process gas may disadvantageously cause corrosion of components inside the turbo-molecular pump. In order to prevent such corrosion, the following countermeasures have been conventionally performed.

Patent Literature 1 (JP 01-095595 Y) describes the invention in which electroless nickel plating is applied to a section (a housing 2, a stator blade 3, rotor 5, a rotor blade 6, a fixed tube 8, and the like) with which gas inside a vacuum chamber makes contact. However, which area of the surface of each of the components is coated with the electroless nickel plating is not specifically described.

Patent Literature 2 (JP 2001-193686 A) describes that the surface of an internal base member is coated with a coating layer which includes a black nickel alloy or a black chromium alloy and fine particles dispersively contained in the alloy. However, components such as a rotor blade body, a stationary blade, the inner face of a main body cylindrical section, the inner face of a flange, a spacer, a protection net, and an exhaust port are merely listed as an example of the internal member, and which area of the surface of each of the components is coated with the coating layer is not specifically described.

In a turbo-molecular pump, a component requiring strength such as a case may be made of a stainless material such as SUS304. Further, a component requiring elasticity such as a ring spring may be made of a spring steel material (SUP material) . The stainless material and the spring steel material contain Fe or Cr. When these components are corroded by process gas, metal particles containing Fe or Cr may be released from the corroded area.

SUMMARY OF THE INVENTION

A turbo-molecular pump comprises: a case having a suction port and a flange; a rotor assembly housed inside the case, the rotor assembly having a shaft and a rotor integrated with the shaft with a fastening bolt, the rotor having a plurality of rotor blades formed thereon; a plurality of stator blades housed inside the case and arranged to face the rotor blades; and a plurality of spacers stacked along a peripheral surface of the case, the spacer fixing the stator blades. An anti-corrosion treatment is applied to a gas contacting section in a component that is provided on an evacuation upstream side with respect to an evacuation downstream side end of the first rotor blade from the evacuation upstream side and made of an alloy containing Fe or Cr.

The component includes a balance plate fixed to the rotor with the fastening bolt, and the anti-corrosion treatment is not applied to abutment surfaces between the fastening bolt and the balance plate.

The component includes a balance plate fixed to the rotor with the fastening bolt, and the anti-corrosion treatment is not applied to abutment surfaces between the rotor and the balance plate.

The anti-corrosion treatment is not applied to abutment surfaces between the rotor and the balance plate.

The balance plate has a cut section cut for balance correction, and the anti-corrosion treatment is applied to the cut section.

A plurality of screw holes are formed on the balance plate and an additional bolt for balance correction is screwed with any of the screw holes, the component includes the additional bolt, and in the screw holes, a screw hole with which the additional bolt is not screwed is included in the gas contacting section.

The turbo-molecular pump further comprises: a protection net attached to a protection net attachment section provided in an inner face of the suction port of the case; and an attachment bolt for fixing the protection net. The component includes the protection net and the attachment bolt, and the protection net attachment section is included in the gas contacting section.

The turbo-molecular pump further comprises: a protection net attached to a protection net attachment section provided in an inner face of the suction port of the case; and an attachment bolt for fixing the protection net. The component includes the attachment bolt, and the protection net attachment section is included in the gas contacting section.

The turbo-molecular pump further comprises: a protection net attached to a protection net attachment section provided in an inner face of the suction port of the case; and a ring spring for fixing the protection net. The component includes the protection net and the ring spring, and the protection net attachment section is included in the gas contacting section.

The turbo-molecular pump further comprises: a protection net attached to a protection net attachment section provided in an inner face of the suction port of the case; and a ring spring for fixing the protection net. The component includes the ring spring, and the protection net attachment section is included in the gas contacting section.

The turbo-molecular pump further comprises: a protection net attached to a protection net attachment section provided in an inner face of the suction port of the case. The protection net is fixed by a projection integrally formed with the protection net, the component includes the protection net, and the protection net attachment section is included in the gas contacting section.

The flange has an O-ring groove formed on a peripheral edge of the suction port, and the anti-corrosion treatment is applied to the O-ring groove and a part of the flange, the part being located on an inner peripheral side with respect to the O-ring groove.

The flange is fixed to a vacuum chamber with a center ring interposed therebetween, and the anti-corrosion treatment is applied to a part of the flange, the part being located on an inner peripheral side with respect to an abutment section abutting on the center ring.

The present invention makes it possible to prevent corrosion of a stainless material or a steel material located on the evacuation upstream side with respect to the first rotor blade to thereby suppress the generation of metal particles containing Fe or Cr which may cause metal contamination.

DETAILED DESCRIPTION OF THE EXEMPLARY EMBODIMENTS

As a result of the research and development, the inventor has obtained the following knowledge regarding the behavior of metal particles. In a turbo-molecular pump, metal particles that are generated on an evacuation downstream side (hereinbelow, referred to as the downstream side) with respect to the first rotor blade from an evacuation upstream side (hereinbelow, referred to as the upstream side) are hit by the first rotor blade toward the downstream side. Accordingly, the metal particles generated on the downstream side with respect to the first rotor blade do not flow to the upstream side. However, metal particles generated on the upstream side with respect to the first rotor blade may be hit by the first rotor blade toward the upstream side. Accordingly, the metal particles located on the upstream side with respect to the first rotor blade may be returned to the upstream side, and may flow back to a vacuum chamber in some cases. Then, the metal particles may enter the inside of the vacuum chamber, and cause metal contamination, specifically, contamination of a semiconductor wafer inside the vacuum chamber. Therefore, by preventing corrosion of at least a component that is located on the evacuation upstream side with respect to the first rotor blade and contains Fe or Cr, the occurrence of the above metal contamination can be prevented.

—Embodiment—

Figure 1:
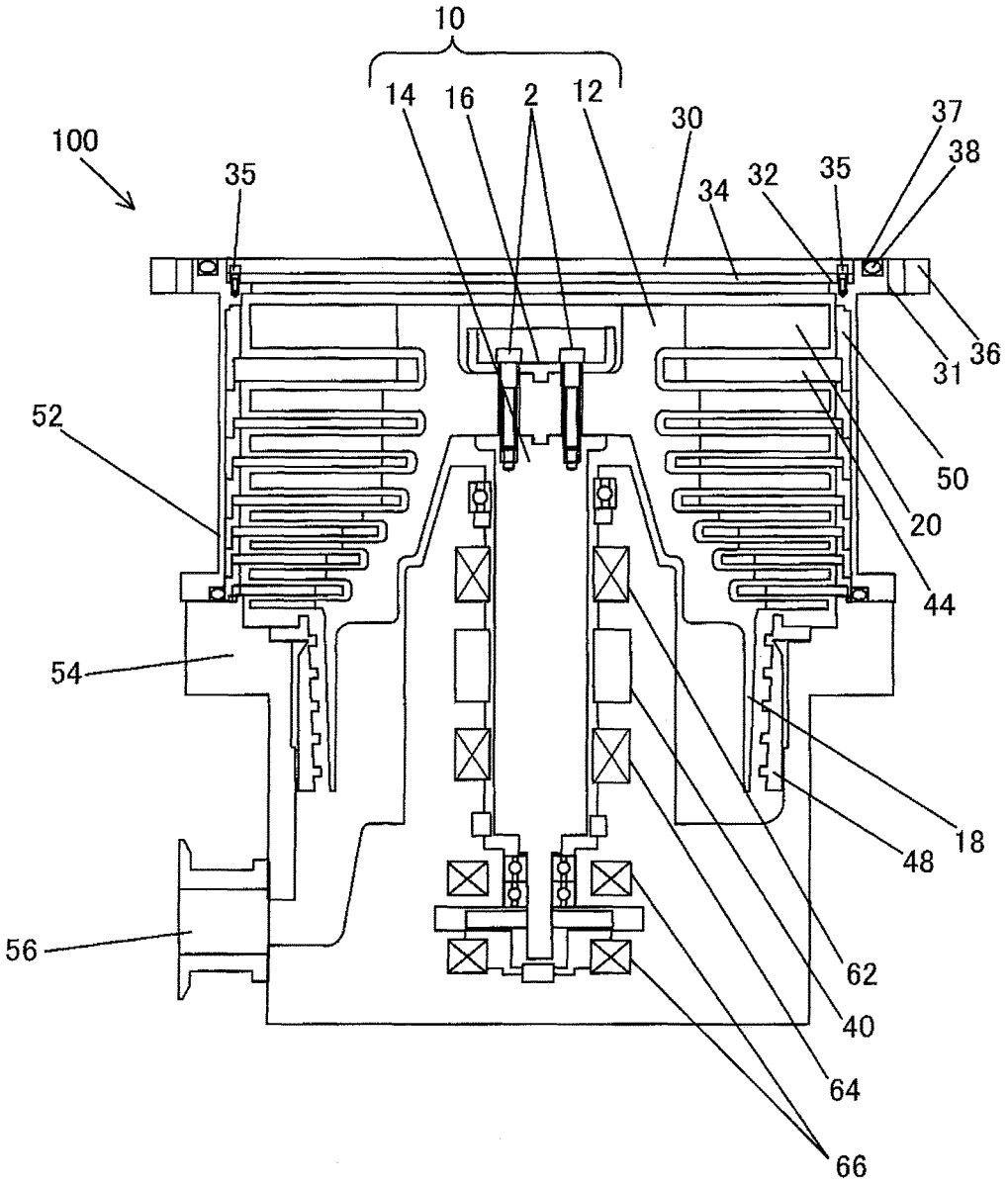
FIG. 1 is a schematic view of a turbo-molecular pump of the present invention.

FIG. 1 is a cross-sectional view illustrating the schematic configuration of a turbo-molecular pump 100. The turbo-molecular pump 100 includes a flange 36 for being attached to a flange of a vacuum chamber. The flange 36 is provided in a suction port 30 of a case 52. A through hole 31 is formed on the flange 36. The flange 36 is attached to the flange of the vacuum chamber with an O-ring 38 interposed therebetween by inserting a bolt into the through hole 31. An O-ring groove 37 is formed on the flange 36, and the O-ring 38 is arranged in the O-ring groove 37. The case 52 is generally made of a stainless material such as SUS304 in order to ensure the strength to resist atmospheric pressure and prevent the case 52 from being destroyed even if a rotor is destroyed. Each of the suction port 30 and the flange 36 is a part of the case 52, and therefore made of the same material as the case 52.

A protection net 34 for preventing foreign substances from entering the turbo-molecular pump 100 is attached to an attachment section 32 of the suction port 30. The protection net 34 is attached to the attachment section 32 and fixed to the attachment section 32 with a bolt 35. The attachment section 32 is a part of the case 52, and therefore made of the same material as the case 52. The protection net 34 is made of a stainless material or an Al alloy. The bolt 35 is generally made of a stainless material.

A rotor assembly 10 is rotatably provided inside the case 52. The turbo-molecular pump 100 is a magnetic bearing type pump. The rotor assembly 10 is supported in a contactless manner by an upper radial electromagnet 62, a lower radial electromagnet 64, and a thrust electromagnet 66.

The rotor assembly 10 includes a rotor 12, a shaft 14, and a balance plate 16 all of which are integrally fastened to each other with a bolt 2. The balance plate 16 is a cutting type balance plate. That is, the position of the center of gravity of the rotor assembly 10 is corrected by cutting the balance plate 16. As the material of the rotor 12, an Al alloy can be used. As the material of the shaft 14, S45C or the like can be used. As the material of the balance plate 16, a stainless material can be used. Since the material of the bolt 2 is preferably the same as the material of a member on which the bolt 2 abuts, a stainless steel member is preferably used in the present embodiment.

A plurality of stages of rotor blades 20 and a cylindrical section 18 are provided in the rotor 12. A plurality of stages of stator blades 44 are provided between the rotor blades 20 in the axial direction. A screw stator 48 is provided on the outer peripheral side of the cylindrical section 18. Each of the stator blades 44 is disposed on a base 54 with a spacer 50 interposed therebetween. When the case 52 is fixed to the base 54, stacked spacers 50 are sandwiched between the base 54 and the case 52, so that each of the stator blades 44 is positioned. As the material of the stator blades 44, an Al alloy can be used. The spacers 50 are preferably made of either a stainless material or an Al alloy in view of the strength and the thermal conductivity. For example, when an energy that is generated when the rotor 12 is destroyed cannot be received only by the case 52, the spacers 50 are made of a stainless steel having high strength. On the other hand, in the case of application that requires improving the heat-releasing property, the spacers 50 are made of an Al alloy.

An exhaust port 56 is provided in the base 54. A back pump is connected to the exhaust port 56. By driving the rotor assembly 10 to rotate at high speed by a motor 40 while magnetically levitating the rotor assembly 10 by the upper radial electromagnet 62, the lower radial electromagnet 64, and the thrust electromagnet 66, gas molecules in the suction port 30 are discharged toward the exhaust port 56.

Since the rotor assembly 10 is a rotary body, components thereof expand by receiving a centrifugal force. The expansion amount (centrifugal force expansion amount) differs among the components. Further, the rotor assembly 10 repeatedly has collision and friction with gas molecules due to its rotation, and thereby generates heat. The components expand with heat, and the expand amount (thermal expansion amount) also differs among the components. In an assembly other than the rotor assembly 10, the thermal expansion amount differs among components. Ni plating is applied with taking the above facts into consideration.

Figure 2:
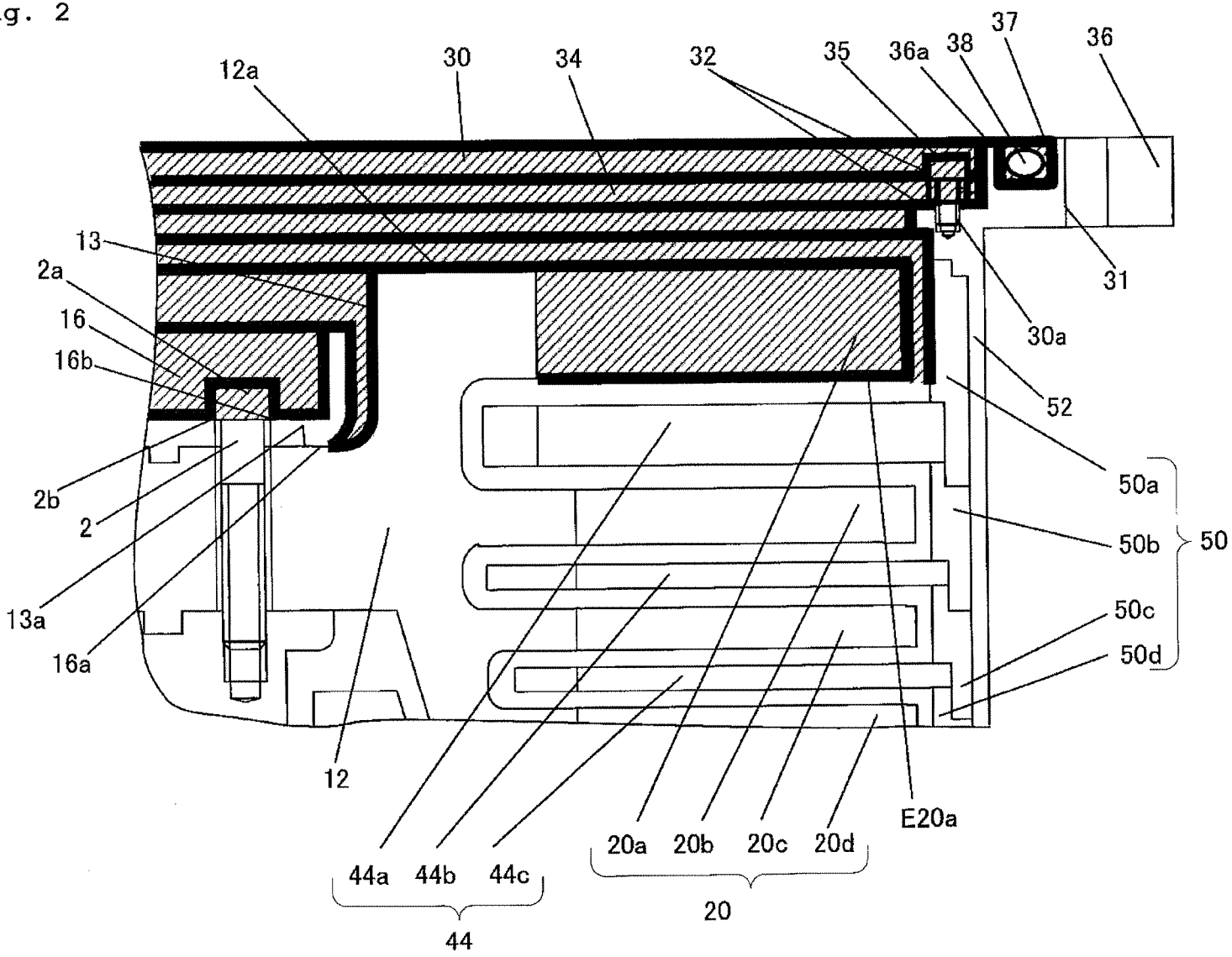
FIG. 2 is a diagram explaining a gas contacting section of the present application.

FIG. 2 is an enlarged view of the upper right part in the drawing of the turbo-molecular pump 100 illustrated in FIG. 1. For convenience of explanation, the rotor blades 20 are denoted as rotor blades 20*a*, 20*b*, 20*c*, 20*d*, . . . in this order from the evacuation upstream side. Similarly, the spacers 50 are denoted as spacers 50*a*, 50*b*, 50*c*, 50*d*, . . . in this order from the evacuation upstream side. Further, the stator blades 44 are also denoted as stator blades 44*a*, 44*b*, 44*c*, . . . in this order from the evacuation upstream side.

In FIG. 2, Ni plating is applied to a part indicated by thick lines and hatching. As described above, a corrosive component is contained in gas drawn from a vacuum chamber evacuated by the turbo-molecular pump 100. In the present embodiment, the Ni plating is applied to a gas contacting section indicated by the thick lines and hatching in a part with which corrosive gas makes contact to thereby prevent the generation of metal particles.

The gas contacting section will be described with reference to FIG. 2. Further, the gas contacting section will be more specifically described with reference to the following drawings. In this specification, "gas contacting section" indicates an area with which process gas makes contact within an area that is located on the evacuation upstream side with respect to an evacuation downstream side end of the first rotor blade from the evacuation upstream side. The gas contacting section in FIG. 2 is an area indicated by the thick lines and hatching, that is, an area that is located on the evacuation upstream side with respect to an evacuation downstream side end E20*a* (hereinbelow, also referred to as the end E20*a*) of the rotor blade 20*a*. Specifically, the gas contacting section includes:

the rotor blade 20*a;* an area in a recess 13 which is formed on the evacuation upstream side of the rotor 12 excepting an abutment surface 13*a* abutting on the balance plate 16;

an area in the balance plate 16 excepting an abutment surface 16*a* abutting on the recess 13 and an abutment surface 16*b* abutting on a bearing surface 2*b* of the bolt 2;

a head 2*a* of the bolt 2 excepting the bearing surface 2*b;* a connection section 12*a* which connects the rotor blade 20*a* and the recess 13 to each other;

an inner peripheral surface of the spacer 50*a*, the inner peripheral surface facing the rotor blade 20*a;* the suction port 30;

the protection net 34;

the attachment section 32 for the protection net 34 (excepting a screw hole 30*a*);

the bolt 35 which fixes the protection net 34 (excepting the screw hole 30*a*);

the entire O-ring groove 37; and a connection section 36*a* of the flange 36, the connection section 36*a* connecting the suction port 30 and the O-ring groove 37 to each other.

Although a partial area of the recess 13 and a partial area of the balance plate 16 are located below the end E20*a* in the drawing, these areas are located on the evacuation upstream side with respect to the end E20*a* in terms of upstream and downstream as an exhaust path. This is because of that, when gas molecules or the like existing near the surfaces of these areas are discharged, the gas molecules necessarily pass through the vicinity of the end E20*a*. That is, when gas molecules are discharged, the gas molecules flow from these areas toward the end E20*a*. Therefore, it can be understood that these areas are located on the evacuation upstream side with respect to the end E20*a*. Thus, these areas are also included in the gas contacting section in this specification.

In an embodiment of the present invention, Ni plating is applied to the above gas contacting section. Although both electroless Ni plating and electrolytic Ni plating can be used, electroless Ni plating is more preferably used in view of high dimension accuracy.

In principle, the Ni plating is separately applied to each component that has an area included in the gas contacting section. When applying the plating, in order to apply the plating only to the gas contacting section, masking is previously applied to the surface of the other area. A reason for separately applying the plating to each component is that if plating is applied to an assembly, a plating layer is formed also on the boundary between components, and the plating layer on the boundary between the components may peel off due to a difference in the centrifugal force expansion amount or the thermal expansion amount among the components.

However, in a rotor assembly which will be described below in Modification 1C, the boundary between components is not located on the gas contacting section of the present application. Therefore, it is possible to apply plating to the rotor assembly in an assembled state. Details thereof will be described in Modification 1C.

Further, since the rotor 12 is made of an Al alloy, metal particles containing Fe or Cr are not generated even if an anti-corrosion treatment is not applied thereto. However, when an anti-corrosion treatment is applied to the rotor 12, it is possible to prevent stress corrosion cracking caused by process gas. Therefore, it is preferred to apply the anti-corrosion treatment also to the rotor 12. Further, also when the protection net is made of an Al alloy, it is not necessary to apply the Ni plating thereto. However, the Ni plating is preferably applied to the protection net due to the same reason as above.

Figure 3:
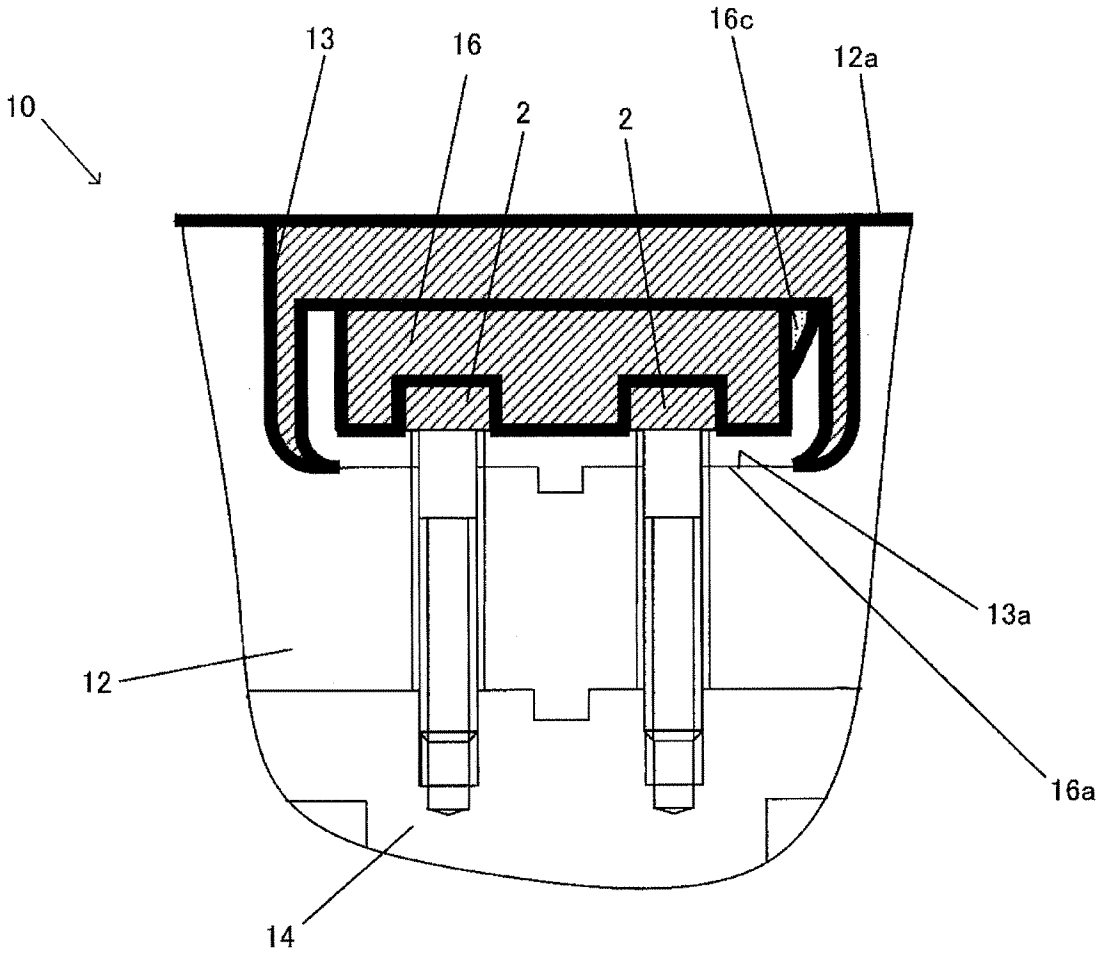
FIG. 3 is a diagram illustrating a fastening section which is located on an evacuation upstream side of a rotor assembly.

FIG. 3 is an enlarged view of the recess 13 of the rotor 12 of the rotor assembly 10 and the vicinity thereof. As described above, the rotor assembly 10 includes the rotor 12, the shaft 14, and the balance plate 16 all of which are fastened to each other with the bolt 2. The gas contacting section illustrated in FIG. 3 includes:

the connection section 12*a* on the top face of the rotor 12, the connection section 12*a* connecting the rotor blade 20*a* and the recess 13 to each other;

the area in the recess 13 formed on the rotor 12 excepting the abutment surface 13*a* abutting on the balance plate 16;

the area in the balance plate 16 excepting the abutment surface 16*a* abutting on the recess 13 and the abutment surface 16*b* abutting on the bearing surface 2*b* of the bolt 2 (also including a cut section 16*c* which will be described below); and the head 2*a* of the bolt 2 excepting the bearing surface 2*b*.

As described above, the Ni plating is applied to the gas contacting section including the above areas. However, epoxy coating is applied only to the cut section 16*c* as will be described below.

Although not illustrated in FIG. 2, the cut section 16*c* is formed on the balance plate 16 illustrated in FIG. 3. In order to correct the position of the center of gravity of the rotor assembly 10, the cut section 16*c* is cut to correct unbalance measured with a balancer, and formed in the inner peripheral surface of the balance plate 16.

Procedures of the assembly of the rotor assembly 10, the correction of the position of the center of gravity, and the Ni plating are as follows. After applying Ni plating only to the gas contacting section in each of the components, the rotor assembly 10 is assembled. After performing a dynamic balance test, the inner peripheral surface of the balance plate 16 is cut to form the cut section 16*c* in order to correct the position of the center of gravity. The cut section 16*c* is included in the gas contacting section. However, the Ni plating is not again applied to the cut section 16*c*, but epoxy coating is applied thereto.

The abutment surface 16*a* of the balance plate 16 and the abutment surface 13*a* of the recess 13 in the rotor 12 abut on each other. Friction occurs between the abutment surface 16*a* and the abutment surface 13*a* due to a difference in the centrifugal force expansion amount or a difference in the thermal expansion amount. When friction between abutment surfaces is large, for example, between the bearing surface 2*b* and the abutment surface 16*b* (described below), the friction may cause peeling-off of the Ni plating. Therefore, purposely, the Ni plating is not applied to these abutment surfaces. However, since the area of the abutment surface 16*a* and the area of the abutment surface 13*a* are large with respect to the fastening force of the rotor assembly 10, the friction between the abutment surface 16*a* and the abutment surface 13*a* is not large enough to cause peeling-off of the Ni plating. Therefore, in the present embodiment, the Ni plating is applied to the abutment surface 16*a* and the abutment surface 13*a*. Accordingly, it is not necessary to apply masking to the abutment surface 16*a* and the abutment surface 13*a*, the cost can be reduced. Further, since the abutment surface 16*a* and the abutment surface 13*a* are not included in the gas contacting section, the Ni plating may not be applied to the abutment surfaces 16*a* and 13*a*.

Figure 4:
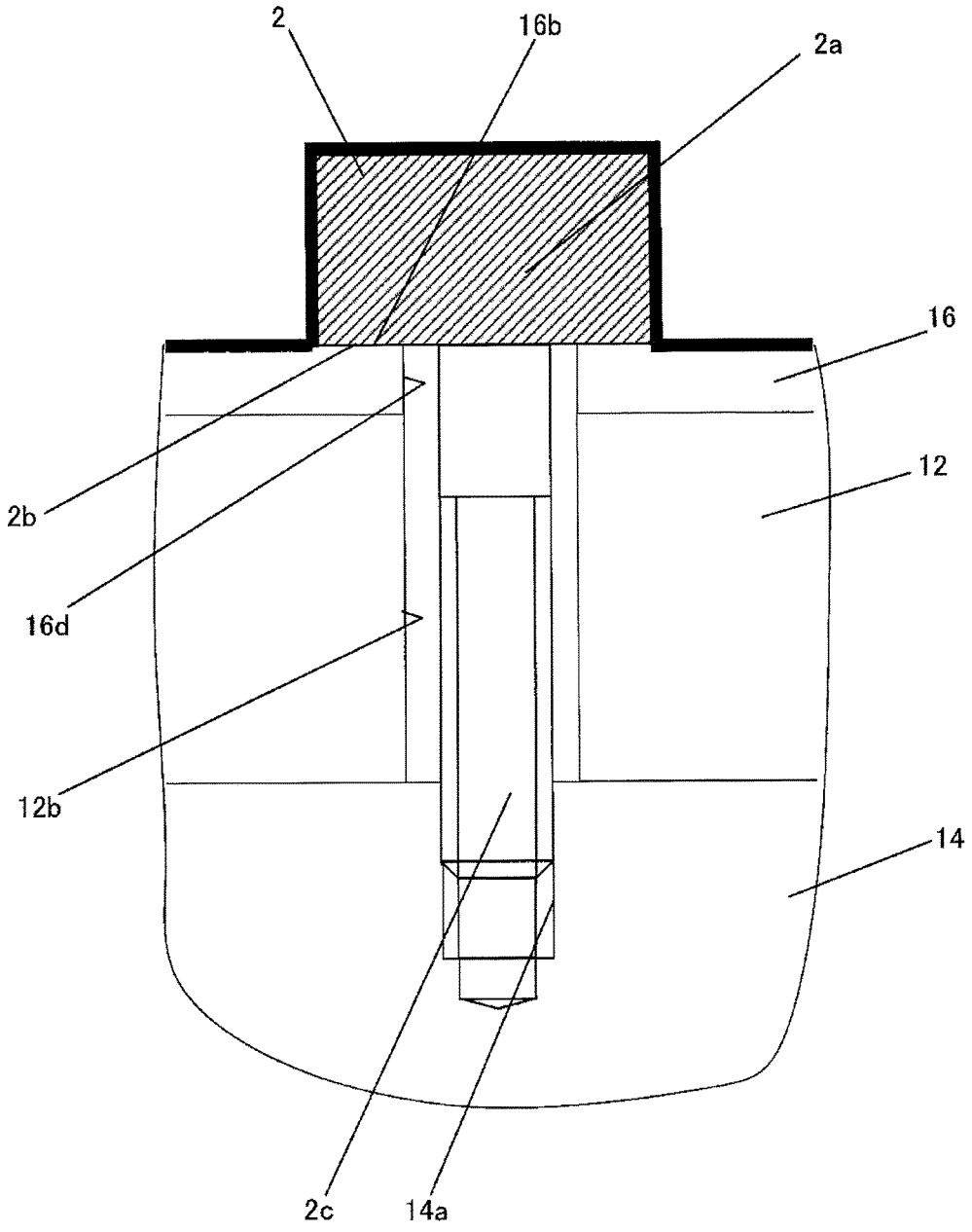
FIG. 4 is an enlarged view of a bolt which fastens the rotor assembly, and the vicinity of the bolt.

FIG. 4 is an enlarge view of the bolt 2 which fastens the rotor assembly 10 and the vicinity thereof. The bearing surface 2*b* of the head 2*a* of the bolt 2 and the abutment surface 16*b* of the balance plate 16 abut on each other. Therefore, friction occurs between the bearing surface 2*b* and the abutment surface 16*b*. Since the area of the bearing surface 2*b* and the area of the abutment surface 16*b* are small with respect to the fastening force of the rotor assembly 10, the friction that occurs between the bearing surface 2*b* and the abutment surface 16*b* is large enough to cause peeling-off of the Ni plating. When the Ni plating peels off and the surface of a component is exposed, the surface is corroded by the process gas, and metal particles may be released from the corroded surface. Further, since the peeling-off of the Ni plating spreads to the peripheral area thereof, an area from which metal particles are released also disadvantageously spreads. Therefore, due to the reason described above, the Ni plating is not applied to the bearing surface 2*b* and the abutment surface 16*b*. Further, since a shaft 2*c* of the bolt 2, a through hole 16*d* of the balance plate 16, a through hole 12*b* of the rotor 12, and a screw hole 14*a* of the shaft 14 do not make contact with the process gas, the Ni plating is not applied thereto. As described above, in the bolt 2, since the area in the head 2*a* excepting the bearing surface 2*b* is included in the gas contacting section, the Ni plating is applied to this area.

Figure 5:
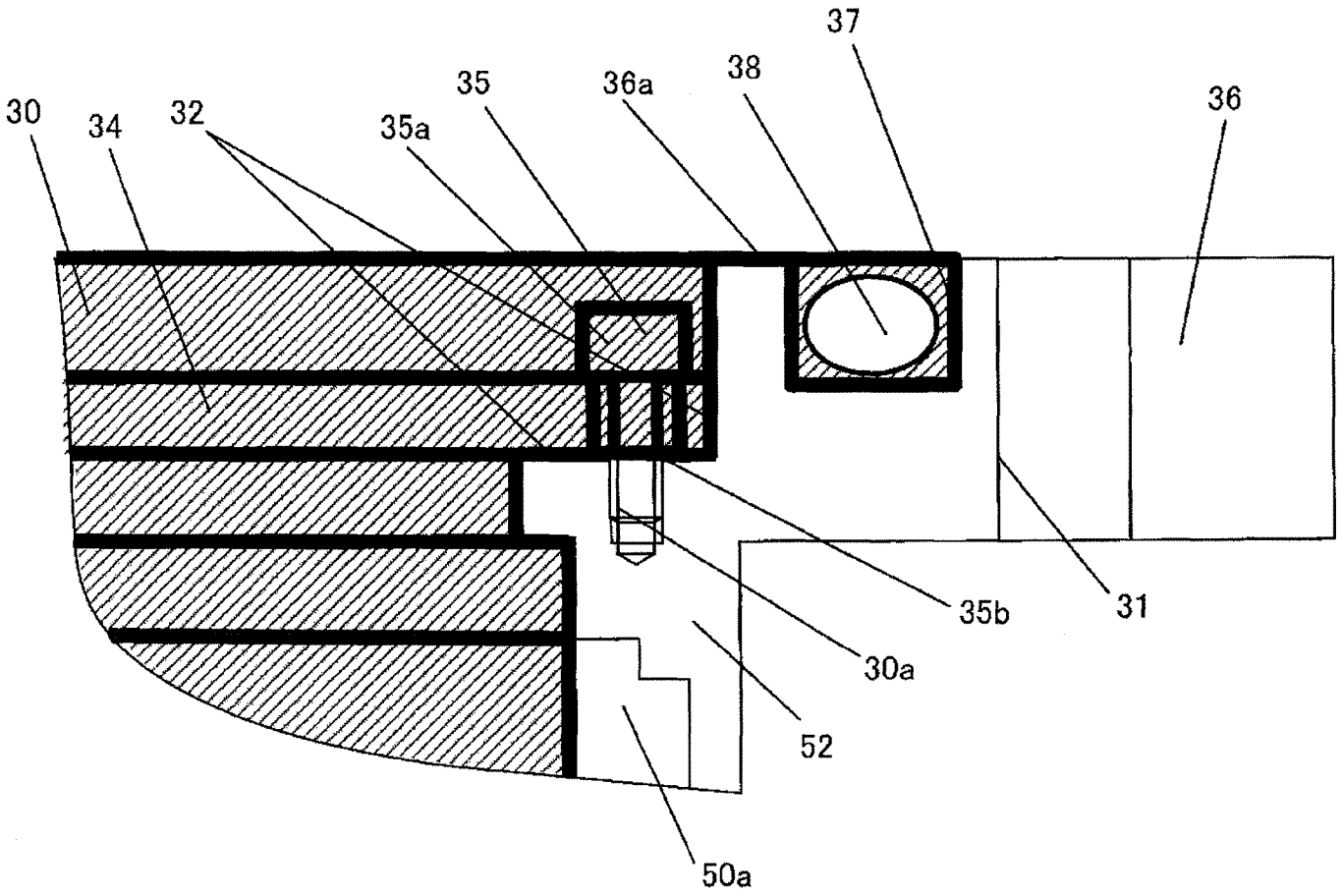
FIG. 5 is an enlarged view of an attachment section for a protection net, an O-ring groove, and the vicinity thereof.

FIG. 5 is an enlarged view of the attachment section 32 for the protection net 34 and the vicinity thereof. The protection net 34 is attached to the attachment section 32 which is a step section provided inside the suction port 30, and fixed thereto with the bolt 35. Since the entire surface of the protection net 34 can be included in the gas contacting section, the Ni plating is applied to the entire surface of the protection net 34. Further, the attachment section 32 can also be included in the gas contacting section, the Ni plating is also applied to the attachment section 32. In the bolt 35, since a head 35*a* thereof can be included in the gas contacting section, the Ni plating is applied to the head 35*a*. Further, since an area in a shaft 35*b* of the bolt 35 excepting a part screwed with the screw hole 30*a* can be included in the gas contacting section, the Ni plating is also applied to this area. Further, the Ni plating can also be applied to surfaces of the protection net 34, the bolt 35, and the attachment section 32, the surfaces abutting on each other. This is because of that, unlike the rotor assembly 10, the protection net 34, the bolt 35, and the attachment section 32 are stationary, less susceptible to heat, and friction is less likely to occur therebetween. However, it is not preferred to apply the Ni plating to these components in an assembled state, the Ni plating is separately applied to each of the components. The Ni plating is applied to the O-ring groove 37 which is formed on the flange 36. The Ni plating is also applied to the connection section 36*a* which connects the O-ring groove 37 and the suction port 30 to each other.

The embodiment described above can achieve the following effects.

(1) Ni plating is applied to the gas contacting section in a component that is located on the evacuation upstream side with respect to the evacuation downstream side end E20*a* of the rotor blade 20*a* which is the first rotor blade 20 from the evacuation upstream side of the turbo-molecular pump 100 and contains Fe or Cr. As a result, corrosion caused by process gas does not occur in the gas contacting section. Therefore, metal particles of Fe or Cr are not generated on the evacuation upstream side with respect to the end 20*a*, and the metal particles do not flow back to the vacuum chamber.

(2) The Ni plating is not applied to both of the abutment surfaces between the balance plate 16 and the bolt 2. As a result, it is possible to prevent peeling-off of the Ni plating caused by the friction between the abutment surfaces due to a difference in the centrifugal force expansion amount or a difference in the thermal expansion amount.

(3) The Ni plating is applied to both of the abutment surfaces between the recess 13 formed on the rotor 12 and the balance plate 16. Since the area of the abutment surface 16*a* and the area of the abutment surface 13*a* are large with respect to the fastening force of the rotor assembly 10, peeling-off of the Ni plating caused by friction does not occur in the abutment area between these abutment surfaces. Therefore, it is not necessary to apply masking for omitting Ni plating, the cost for the masking can be reduced.

In Patent Literature 1, a component that is located on the evacuation downstream side with respect to the evacuation downstream side end E20*a* of the rotor blade 20*a* which is the first rotor blade 20 from the evacuation upstream side (the fixed tube 8, for example) is also coated with electroless nickel plating. On the other hand, in the present invention, Ni plating is applied only to the gas contacting section described in this specification to thereby prevent metal particles from flowing back to the vacuum chamber. Therefore, the number of components to which Ni plating is applied in the present invention can made smaller than that in the invention disclosed in Patent Literature 1.

Further, in Patent Literature 1, although a component to be coated is described, a part that is actively not coated is not described. On the other hand, in the present invention, a part to which the Ni plating is not applied in view of the peeling-off of the Ni plating is clearly indicated as described above. As a result, in the present invention, the peeling-off of the Ni plating is less likely to occur than the invention disclosed in Patent Literature 1.

Modifications of the above embodiment will be described below. Description of the same parts as those of the above embodiment will be omitted. By applying Ni plating to a gas contacting section described below, the generation of metal particles containing Fe or Cr which may cause metal contamination can be suppressed.

—Modification 1A—

Figure 6:
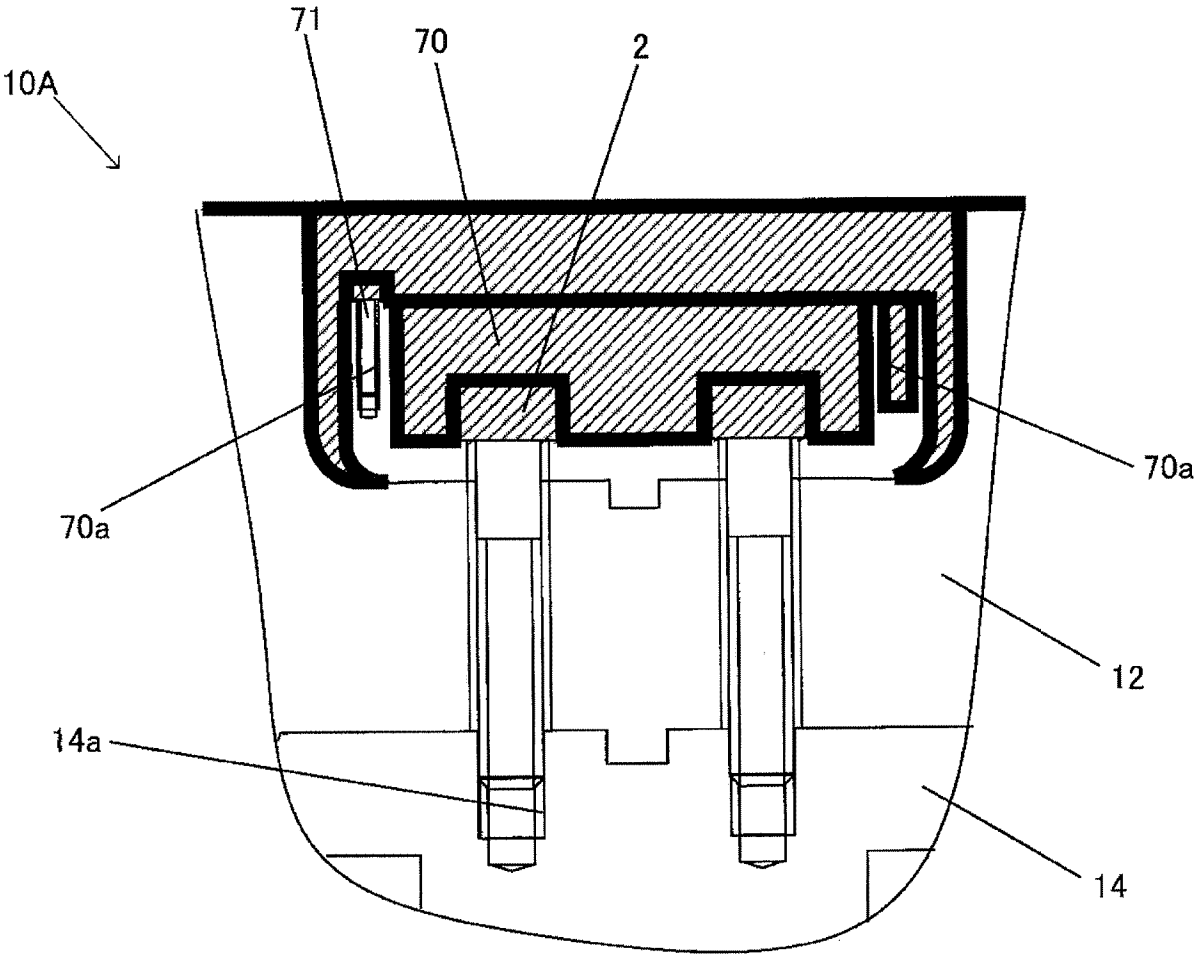
FIG. 6 is a diagram illustrating Modification 1A which is a modification of the rotor assembly.

Modification 1A, and Modifications 1B and 1C (described below) are modifications of the rotor assembly 10. In a rotor assembly 10A of Modification 1A illustrated in FIG. 6, a weight addition type balance plate 70 is used instead of the cutting type balance plate 16. More specifically, a plurality of screw holes (tap sections) 70*a* are formed on the balance plate 70 in the circumferential direction, and bolts are screwed with the screw holes 70*a* to thereby correct the position of the center of gravity of the rotor assembly 10A.

In order to correct the position of the center of gravity, a weight addition bolt 71 is screwed with a screw hole 70*a* located on the left side in the drawing. As a manner of applying the Ni plating to the weight addition bolt 71, since only the head of the weight addition bolt 71 excepting a bearing surface thereof is included in the gas contacting section as with the bolt 2 illustrated in FIG. 4, the Ni plating is applied to the head excepting the bearing surface. Since a screw hole with which the weight addition bolt 71 is screwed is not included in the gas contacting section, it is not necessary to apply the Ni plating to the screw hole. However, before checking the position of the center of gravity of the rotor assembly 10A, that is, before confirming which screw hole 70*a* the weight addition bolt 71 is screwed with and is therefore not included in the gas contacting section, the Ni plating is applied to the balance plate 70. Therefore, it is necessary to apply the Ni plating to all of the screw holes 70*a*. Thus, the Ni plating is applied to both of the screw hole 70*a* (left side in the drawing) with which the weight addition bolt 71 is screwed and the screw hole 70*a* (right side in the drawing) with which the weight addition bolt 71 is not screwed.

—Modification 1B—

Figure 7:
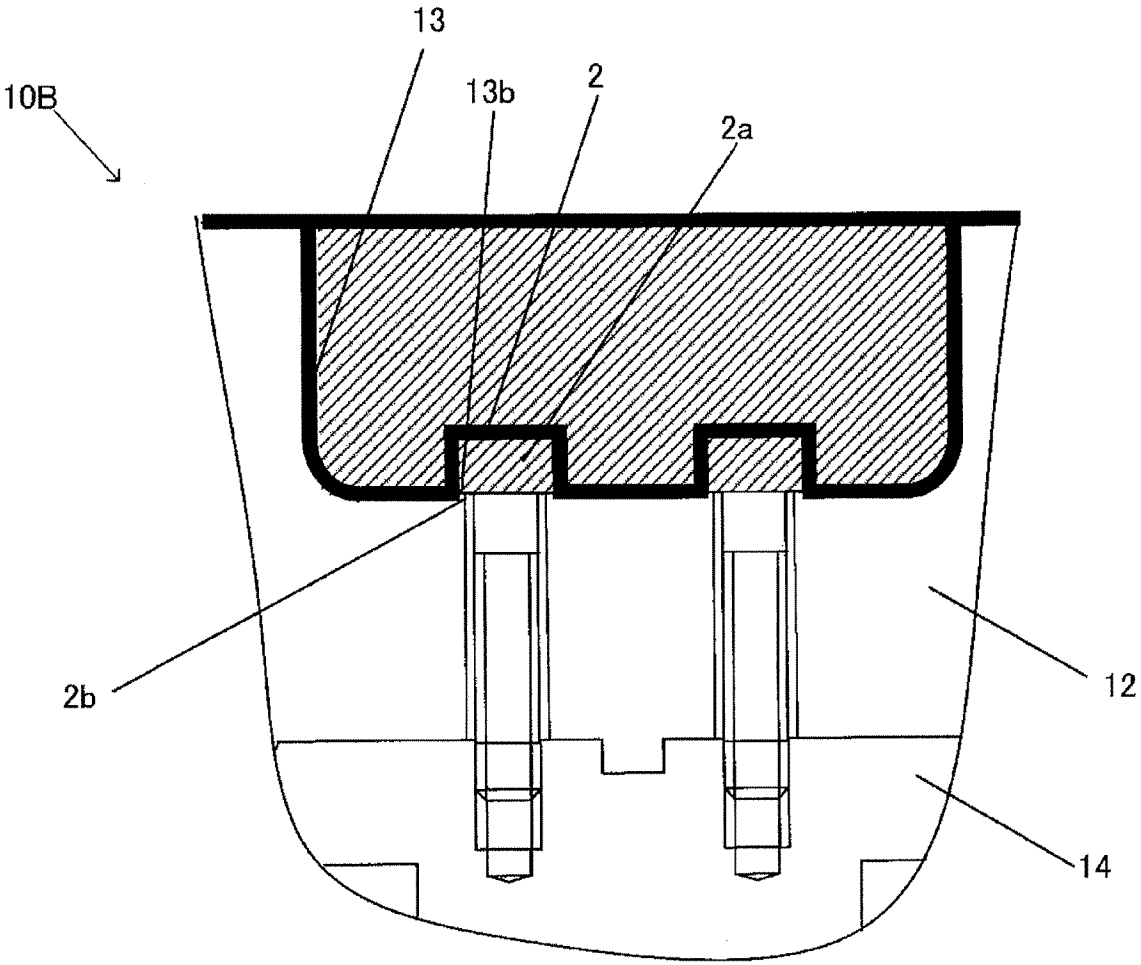
FIG. 7 is a diagram illustrating Modification 1B which is a modification of the rotor assembly.

In a rotor assembly 10B in Modification 1B illustrated in FIG. 7, the balance plate 16 illustrated in the embodiment is omitted. Therefore, a bolt 2 abuts on a recess 13 of a rotor 12. As with the bolt 2 illustrated in FIG. 4, also in the bolt 2 of Modification 1B, an area in a head 2*a* excepting a bearing surface 2*b* is included in the gas contacting section. Therefore, the Ni plating is applied to the area in the head 2*a* excepting the bearing surface 2*b*. Further, the Ni plating is applied to the recess 13 excepting an area that abuts on the bearing surface 2*b*.

—Modification 1C—

Figure 8:
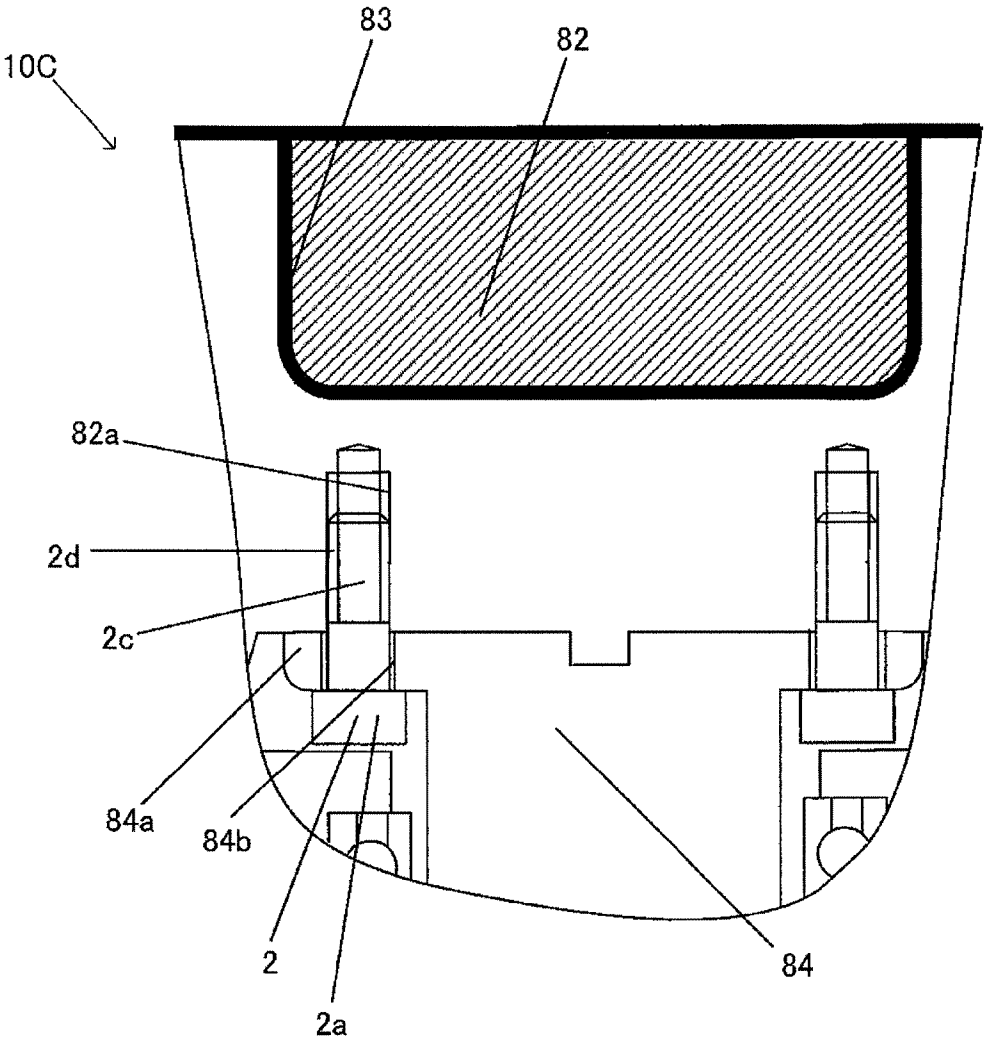
FIG. 8 is a diagram illustrating Modification 1C which is a modification of the rotor assembly.

In a rotor assembly 10C in Modification 1C illustrated in FIG. 8, a rotor 82 is provided instead of the rotor 12 and a shaft 84 is provided instead of the shaft 14. Further, the balance plate 16 is not provided. A method of fastening the rotor assembly 10C is largely different from the method of fastening the rotor assemblies 10, 10A, and 10B. A flange 84*a* is formed on the shaft 84. A thorough hole 84*b* is formed on the flange 84*a*. A screw hole 82*a* is formed on the back face of a recess 83 of the rotor 82. The bolt 2 is inserted through the through hole 84*b*, and a screw section 2*d* on a shaft 2*c* of the bolt 2 is screwed with the screw hole 82*a*. As a result, the rotor 82 and the shaft 84 are fastened to each other.

The fastening section of the rotor assembly 10C is located on the evacuation downstream side with respect to the evacuation downstream side end of the first rotor blade from the evacuation upstream side of the rotor 82 inside the turbo-molecular pump 100. Therefore, the bolt 2 and the vicinity thereof in Modification 1C are not included in the gas contacting section, and therefore not required to be coated with Ni plating. Further, the fastening section is not located on the evacuation upstream side with respect to the evacuation downstream side end of the first rotor blade from the evacuation upstream side of the rotor 82. In other words, only the surface of the rotor 82 is located on the evacuation upstream side. Therefore, the Ni plating may be applied to the rotor assembly 10C in an assembled state without being separately applied to each of the components of the rotor assembly 10C. When the Ni plating is separately applied to each of the components, since only the rotor 82 of the rotor assembly 10C has an area included in the gas contacting section, it is only necessary to apply the Ni plating only to the gas contacting section in the rotor 82.

—Modification 2A—

Figure 9:
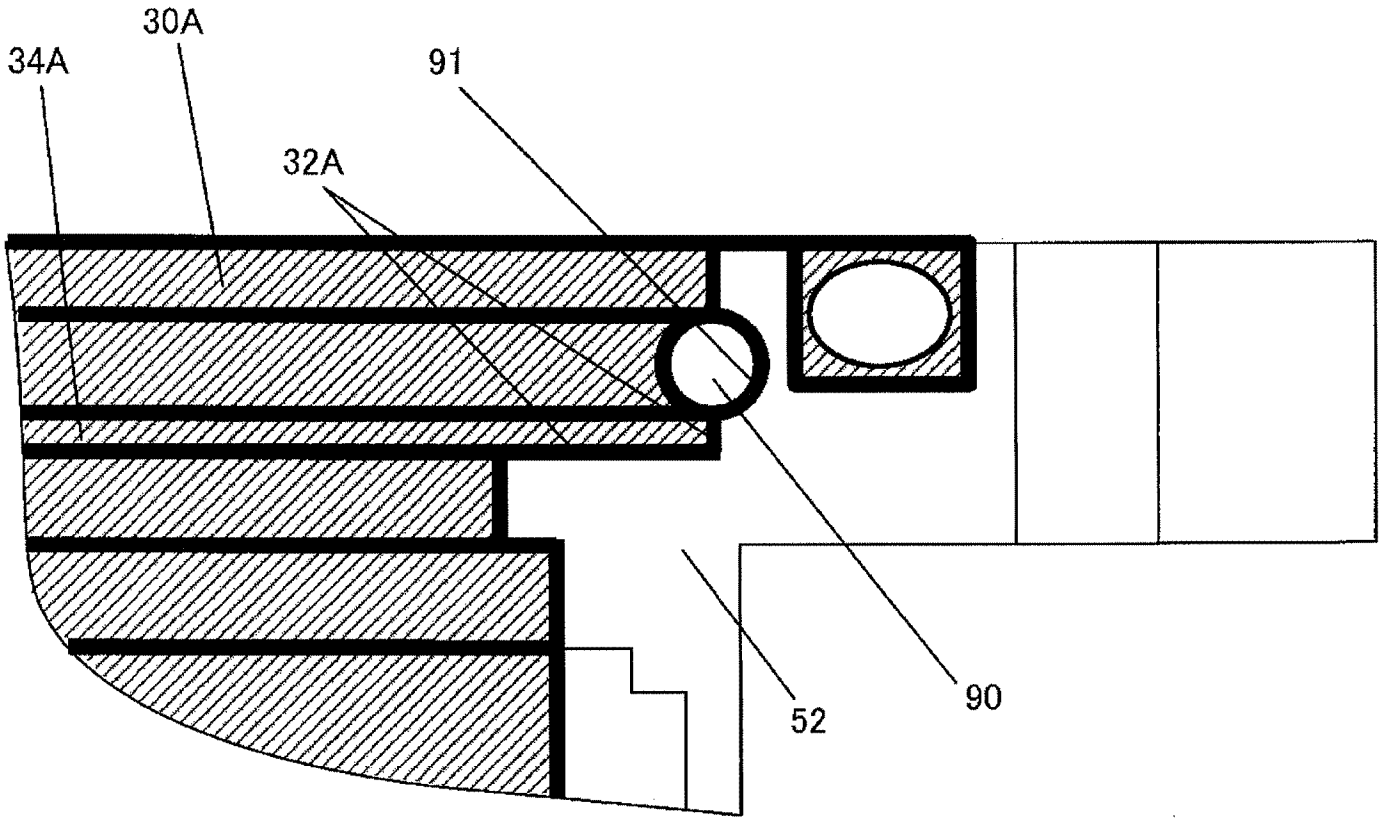
FIG. 9 is a diagram illustrating Modification 2A which is a modification regarding fixing of the protection net.

Modification 2A and Modification 2B (described below) are modifications regarding the fixing of a protection net. A protection net 34A in Modification 2A illustrated in FIG. 9 is attached to an attachment section 32A which is provided in a suction port 30A of a case 52. Further, a ring spring 90 is attached to an attachment section 91 which is provided in the suction port 30A to thereby fix the protection net 34A. Unlike the protection net 34 of FIG. 2, no attachment through hole for inserting a bolt thereinto is formed on the protection net 34A. Further, as illustrated in FIG. 2, the screw hole 30*a* with which the bolt 35 is screwed is formed on the suction port 30 in the embodiment. However, no screw hole is formed on the suction port 30A.

As with the protection net 34 of the embodiment, the protection net 34A is made of a stainless material or an Al alloy. Since the entire surface of the protection net 34A can also be included in the gas contacting section, the Ni plating is applied to the entire surface of the protection net 34A. Further, the ring spring 90 is made of a spring steel material (SUP material). Since the entire surface of the ring spring 90 can also be included in the gas contacting section, the Ni plating is applied to the entire surface of the ring spring 90. Further, since the suction port 30A is also included in the gas contacting section, the Ni plating is also applied to the suction port 30A. Therefore, the Ni plating is also applied to the attachment section 32A and the attachment section 91 which are provided in the suction port 30A.

—Modification 2B—

Figure 10:
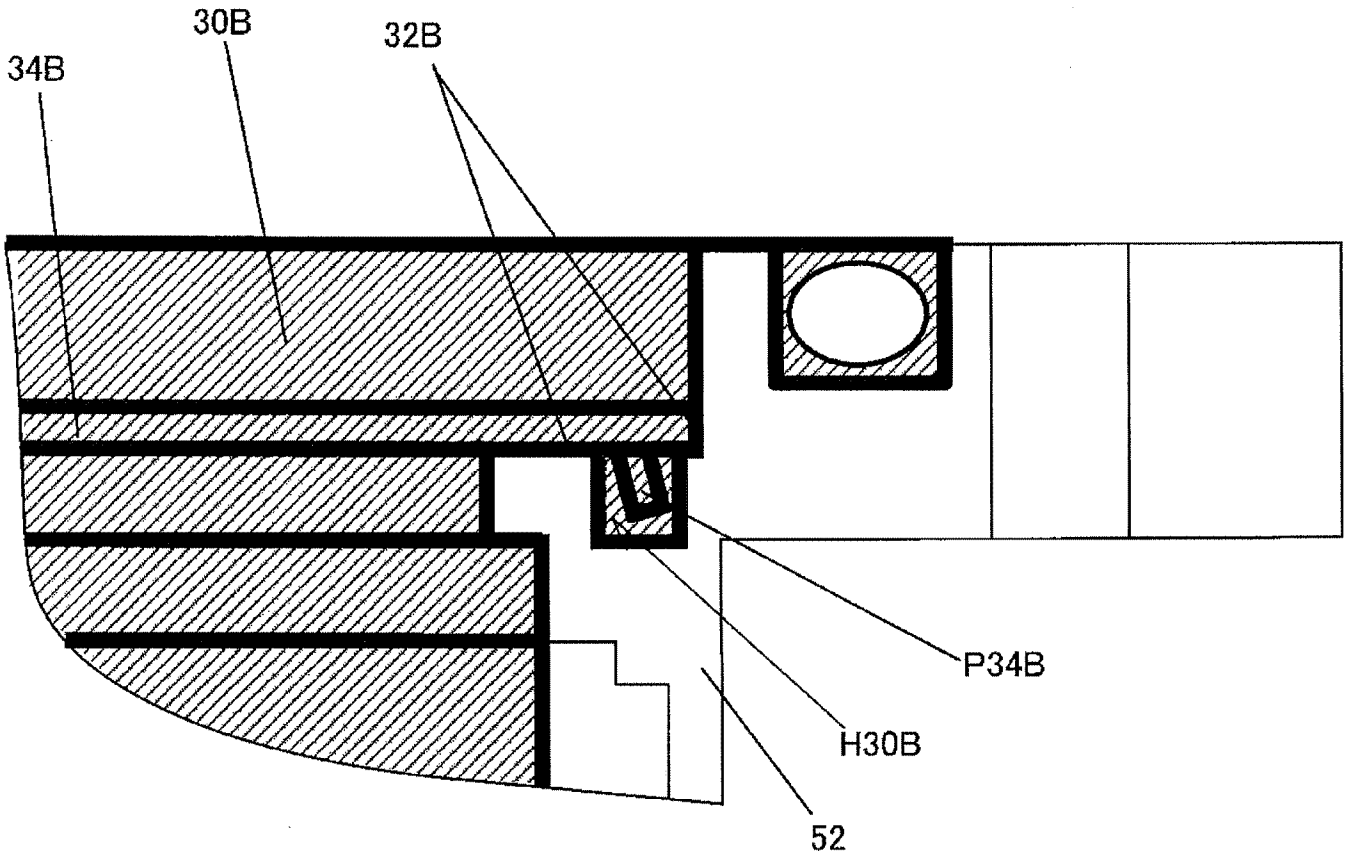
FIG. 10 is a diagram illustrating Modification 2B which is a modification regarding fixing of the protection net.

In a protection net 34B in Modification 2B illustrated in FIG. 10, a projection P34B for fixing the protection net 34B itself is integrally formed with the protection net 34B. Further, an attachment section 32B for attaching the protection net 34B thereto is provided in a suction port 30B. Further, a hole H30B with which the projection P34B is fitted is formed on the suction port 30B. As a result, when the protection net 34B is attached to the attachment section 32B, the projection P34B is fitted with the hole H30B at the same time, so that the protection net 34B is fixed to the attachment section 32B.

Since the projection P34B is required to have enough elasticity to fix the protection net 34B to the attachment section 32B, the protection net 34B is made of a stainless material. Since the entire surface of the protection net 34B including the projection P34B can also be included in the gas contacting section, the Ni plating is applied to the entire surface of the projection P34B. Further, since the entire surface of the hole H30B can also be included in the gas contacting section, the Ni plating is also applied to the entire surface of the hole H30B. Further, since the suction port 30B is also included in the gas contacting section, the Ni plating is also applied to the suction port 30B. Therefore, the Ni plating is also applied to the attachment section 32B provided in the suction port 30B.

—Modification 3—

Figure 11:
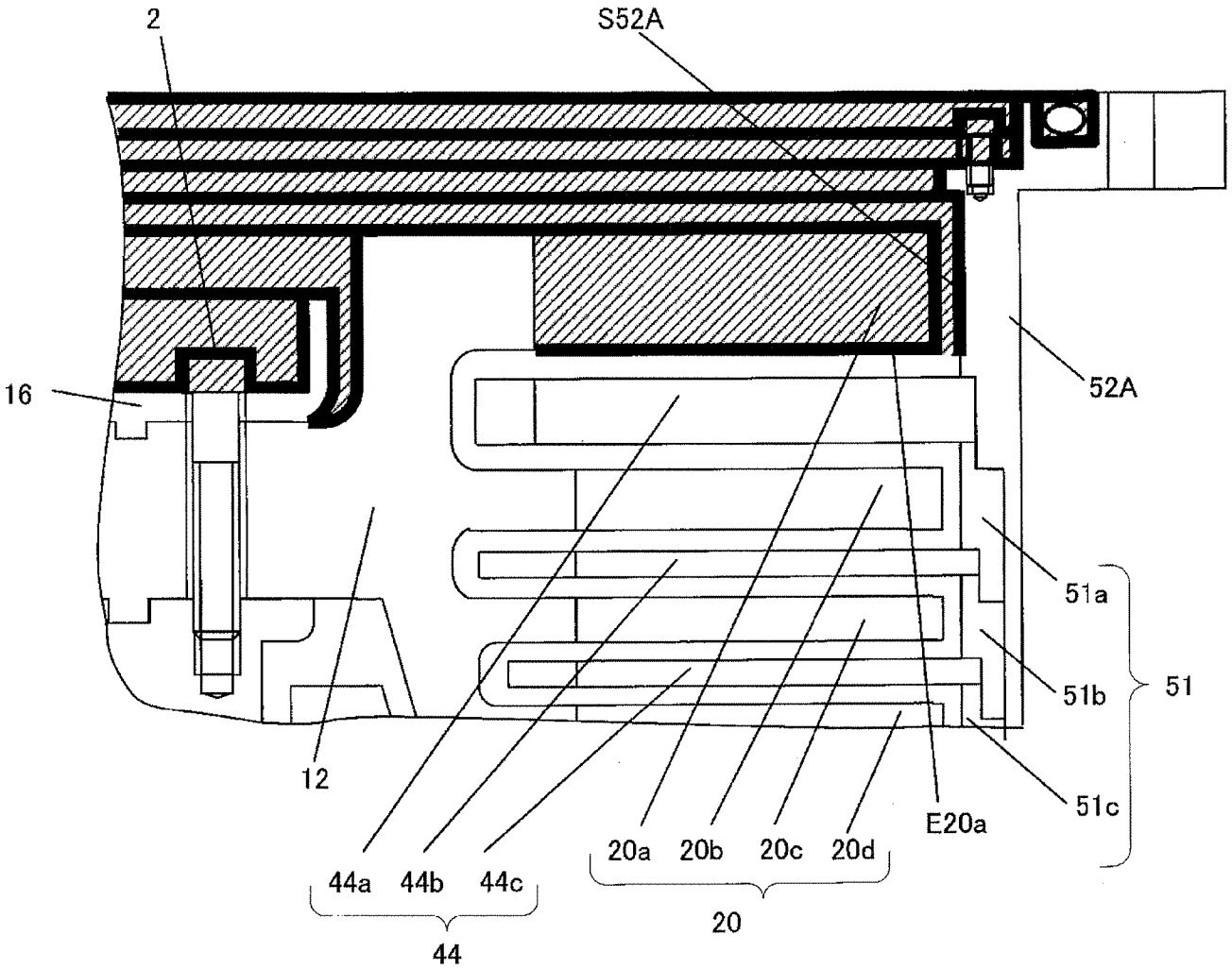
FIG. 11 is a diagram illustrating Modification 3 which is a modification of a case and a spacer.

Modification 3 is a modification regarding a case and a spacer. In the above embodiment, as illustrated in FIG. 2, the rotor blade 20*a* which is the first rotor blade 20 from the evacuation upstream side faces the spacer 50*a*. On the other hand, the inner peripheral surface of a case 52A of Modification 3 illustrated in FIG. 11 faces a rotor blade 20*a*. In the case of Modification 3, it is not necessary to apply Ni plating to a spacer 51*a* which is located on the most upstream of an evacuation system. Instead, since an inner peripheral surface S52A which faces the rotor blade 20*a* in the inner peripheral surface of the case 52A is included in the gas contacting section, the Ni plating is applied to the inner peripheral surface S52A.

—Modification 4—

Figure 12:
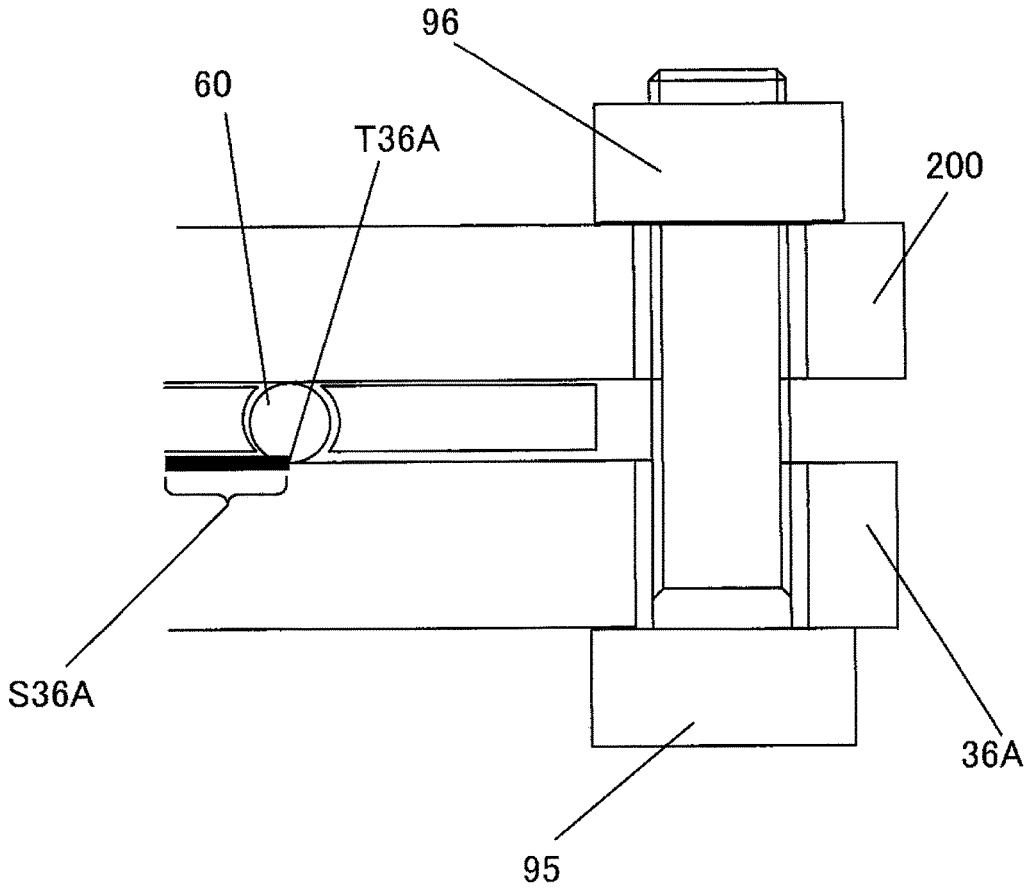
FIG. 12 is a diagram illustrating Modification 4 which is a modification of a flange.

Modification 4 is a modification regarding a flange. In the above embodiment, for example, the O-ring groove 37 is formed on the flange 36 of FIG. 5. That is, such an O-ring groove is formed on a flange represented by a JIS-VG flange or the like. On the other hand, a flange 36A of Modification 4 is represented by an ISO-LF flange or the like, and no O-ring groove is formed thereon. As illustrated in FIG. 12, the flange 36A is fastened to an exhaust port flange 200 of a vacuum chamber or the like with a center ring 60 interposed therebetween using a bolt 95 and a nut 96.

When the flange 36A is fastened in the above manner, the flange 36A abuts on the center ring 60 through an abutment section T36A of the flange 36A. In the flange 36A, a flange surface S36A which is located on the inner peripheral side with respect to the abutment section T36A is included in the gas contacting section. Therefore, the Ni plating is applied to the flange surface S36A.

In Modification 4, the flange is fastened using the bolt and the nut. However, the shape of the flange may be appropriately modified, and the flange may be fastened using a single claw clamp or a double claw clamp instead of the bolt and the nut.

In the above embodiment, the Ni plating is applied to the gas contacting section. However, the following anti-corrosion treatment other than the Ni plating can be applied. For example, in a component that is made of a stainless material, Al alloy deposition or epoxy coating can be applied. Further, Ni plating can also be performed using an electroless Ni plating solution containing fluororesin.

In Patent Literature 2, black Ni plating or black Cr plating is used. However, in the present invention, black Ni plating and black Cr plating are not used due to the following reason. Specifically, a process for applying black Ni plating or black Cr plating includes an etching process, and extremely fine irregularities are formed on the plating surface due to the etching process. The extremely fine irregularities may be released from the plating surface as metal particles, and act as a contamination source in a vacuum chamber.

The above description is merely an example, and the present invention is therefore not limited at all to the above embodiment.

What is claimed is:

1. A turbo-molecular pump comprising:

a case having a suction port and a flange;

a rotor assembly housed inside the case, the rotor assembly having a shaft and a rotor integrated with the shaft with a fastening bolt, the rotor having a plurality of rotor blades formed thereon;

a plurality of stator blades housed inside the case and arranged to face the rotor blades; and a plurality of spacers stacked along a peripheral surface of the case, the spacers fixing the stator blades, wherein the turbo-molecular pump includes a gas contacting section having an evacuation upstream side with respect to an evacuation downstream side end of the first rotor blade, and an evacuation downstream side with respect to the evacuation downstream side end of the first rotor blade, and the turbo-molecular pump includes components made of alloy containing Fe or Cr provided on the evacuation upstream side and components made of alloy containing Fe or Cr provided on the evacuation downstream side, wherein an anti-corrosion treatment is applied to a majority of components provided on the evacuation upstream side, and the anti-corrosion treatment is not applied to a majority of the components provided on the evacuation downstream side.

2. The turbo-molecular pump according to claim 1, wherein:

the components include a balance plate fixed to the rotor with the fastening bolt, and the anti-corrosion treatment is not applied to abutment surfaces between the fastening bolt and the balance plate.

3. The turbo-molecular pump according to claim 2, wherein the anti-corrosion treatment is not applied to abutment surfaces between the rotor and the balance plate.

4. The turbo-molecular pump according to claim 2, wherein the balance plate has a cut section cut for balance correction, and the anti-corrosion treatment is applied to the cut section.

5. The turbo-molecular pump according to claim 2, wherein a plurality of screw holes are formed on the balance plate and an additional bolt for balance correction is screwed with any of the screw holes, the component includes the additional bolt, and in the screw holes, a screw hole with which the additional bolt is not screwed is included in the gas contacting section.

6. The turbo-molecular pump according to claim 1, wherein the component includes a balance plate fixed to the rotor with the fastening bolt, and the anti-corrosion treatment is not applied to abutment surfaces between the rotor and the balance plate.

7. The turbo-molecular pump according to claim 6, wherein the balance plate has a cut section cut for balance correction, and the anti-corrosion treatment is applied to the cut section.

8. The turbo-molecular pump according to claim 6, wherein a plurality of screw holes are formed on the balance plate and an additional bolt for balance correction is screwed with any of the screw holes, the component includes the additional bolt, and in the screw holes, a screw hole with which the additional bolt is not screwed is included in the gas contacting section.

9. The turbo-molecular pump according to claim 1, further comprising:

a protection net attached to a protection net attachment section provided in an inner face of the suction port of the case; and an attachment bolt for fixing the protection net, wherein the component includes the protection net and the attachment bolt, and the protection net attachment section is included in the gas contacting section.

10. The turbo-molecular pump according to claim 1, further comprising:

a protection net attached to a protection net attachment section provided in an inner face of the suction port of the case; and an attachment bolt for fixing the protection net, wherein the component includes the attachment bolt, and the protection net attachment section is included in the gas contacting section.

11. The turbo-molecular pump according to claim 1, further comprising:

a protection net attached to a protection net attachment section provided in an inner face of the suction port of the case; and a ring spring for fixing the protection net, wherein the component includes the protection net and the ring spring, and the protection net attachment section is included in the gas contacting section.

12. The turbo-molecular pump according to claim 1, further comprising:

a protection net attached to a protection net attachment section provided in an inner face of the suction port of the case; and a ring spring for fixing the protection net, wherein the component includes the ring spring, and the protection net attachment section is included in the gas contacting section.

13. The turbo-molecular pump according to claim 1, further comprising a protection net attached to a protection net attachment section provided in an inner face of the suction port of the case, wherein the protection net is fixed by a projection integrally formed with the protection net, the component includes the protection net, and the protection net attachment section is included in the gas contacting section.

14. The turbo-molecular pump according to claim 1, wherein the flange has an O-ring groove formed on a peripheral edge of the suction port, and the anti-corrosion treatment is applied to the O-ring groove and a part of the flange, the part being located on an inner peripheral side with respect to the O-ring groove.

15. The turbo-molecular pump according to claim 1, wherein the flange is fixed to a vacuum chamber with a center ring interposed therebetween, and the anti-corrosion treatment is applied to a part of the flange, the part being located on an inner peripheral side with respect to an abutment section abutting on the center ring.

* * * * *